United States Patent [19]

Hori

[11] 4,437,777

[45] Mar. 20, 1984

[54] PRINTER HAVING PLURAL TYPE WHEEL ASSEMBLY

[75] Inventor: Fumihisa Hori, Tamayama, Japan

[73] Assignee: Alps Electric Co., Ltd., Tokyo, Japan

[21] Appl. No.: 344,308

[22] Filed: Feb. 1, 1982

[30] Foreign Application Priority Data

Feb. 2, 1981 [JP] Japan ..... 56-12981

[51] Int. Cl.[3] ..... B41J 1/34

[52] U.S. Cl. ..... 400/154.2; 400/315; 400/317; 101/93.16; 101/93.17

[58] Field of Search ..... 400/152, 154, 154.1, 400/154.2, 154.3, 154.5, 154.4, 155, 155.1, 156, 156.1, 156.2, 156.3, 315, 317; 101/93.15, 93.16, 93.17

[56] References Cited

U.S. PATENT DOCUMENTS

| | | | |
|---|---|---|---|
| Re. 30,942 | 3/1982 | Takenaka | 400/154.5 X |
| 2,375,541 | 5/1945 | Dirkes et al. | 178/34 X |
| 3,256,969 | 6/1966 | Bretti | 400/154.2 |
| 3,354,818 | 11/1967 | Haas | 101/93.16 |
| 3,378,127 | 4/1968 | Clary et al. | 400/154.2 |
| 3,482,511 | 12/1969 | Tauchert et al. | 101/93.16 |
| 3,651,914 | 3/1972 | Locke | 400/154.4 X |
| 3,724,631 | 4/1973 | Kaczeus | 400/152 X |
| 3,800,933 | 4/1974 | Taylor | 400/157 |
| 3,927,753 | 12/1975 | Donovan et al. | 400/154.2 |
| 4,039,067 | 8/1977 | Kashio | 197/49 |
| 4,051,942 | 10/1977 | Suzuki et al. | 400/154.2 X |
| 4,310,256 | 1/1982 | Inoue | 400/185 |
| 4,337,697 | 7/1982 | Aoki et al. | 400/247 X |
| 4,352,576 | 10/1982 | Hori et al. | 400/154.4 |

FOREIGN PATENT DOCUMENTS

| | | | |
|---|---|---|---|
| 2056918 | 3/1981 | United Kingdom | 101/93.15 |

OTHER PUBLICATIONS

Schaefer, "Automatic Carriage Return;" *IBM Technical Disclosure Bulletin*; vol. 11, No. 3, Aug. 1968, p. 261.

*Primary Examiner*—Clifford D. Crowder

*Attorney, Agent, or Firm*—Guy W. Shoup; Gerard F. Dunne

[57] ABSTRACT

In a printer for desk calculators etc., return control means is disposed in order to control return means for resetting a carriage as well as a hammer to a starting position. When a type wheel has been shifted to a specified position in a carry direction and has opposed to the hammer at a specified rotational position, the return control means actuates the return means on the basis of a next carry operation.

11 Claims, 19 Drawing Figures

PRINTER HAVING PLURAL TYPE WHEEL ASSEMBLY

BACKGROUND OF THE INVENTION

The present invention relates to a printer, and more particularly to a serial printer.

Recent electronic desk calculators have become multifunctional, and the type of input keys used in desk calculators, such as programmable desk calculators and the like, has increased. A printer for such electronic desk calculators should, therefore, be capable of printing alphanumeric characters by a matrix printing technique to provide clear print data.

SUMMARY OF THE INVENTION

An object of the present invention is to provide a printer which is small in size and which is capable of alphanumeric printing.

According to the present invention, a printer is provided which comprises a carriage which can be shifted in a direction orthogonal to the direction for feeding paper, hammer means adapted to be shifted unitarily with said carriage on a side opposite to said paper, carry means for said carriage and said hammer means, type wheel means held rotatable and also slidable in the shift direction of said carriage a predetermined amount within said carriage and formed with types in a plurality of columns on its cylindrical outer periphery, shift means for sliding said type wheel means within said carriage, return means for resetting said carriage as well as said hammer means to a starting position, and return control means for actuating said return means on the basis of an operation of said carry means, so that when the type carrier has been shifted to a specified position in a carry direction and has opposed to said hammer means at a specified rotational position, said return control means actuates said return means on the basis of a next carry operation.

DETAILED DESCRIPTION OF THE INVENTION

Figure 1:
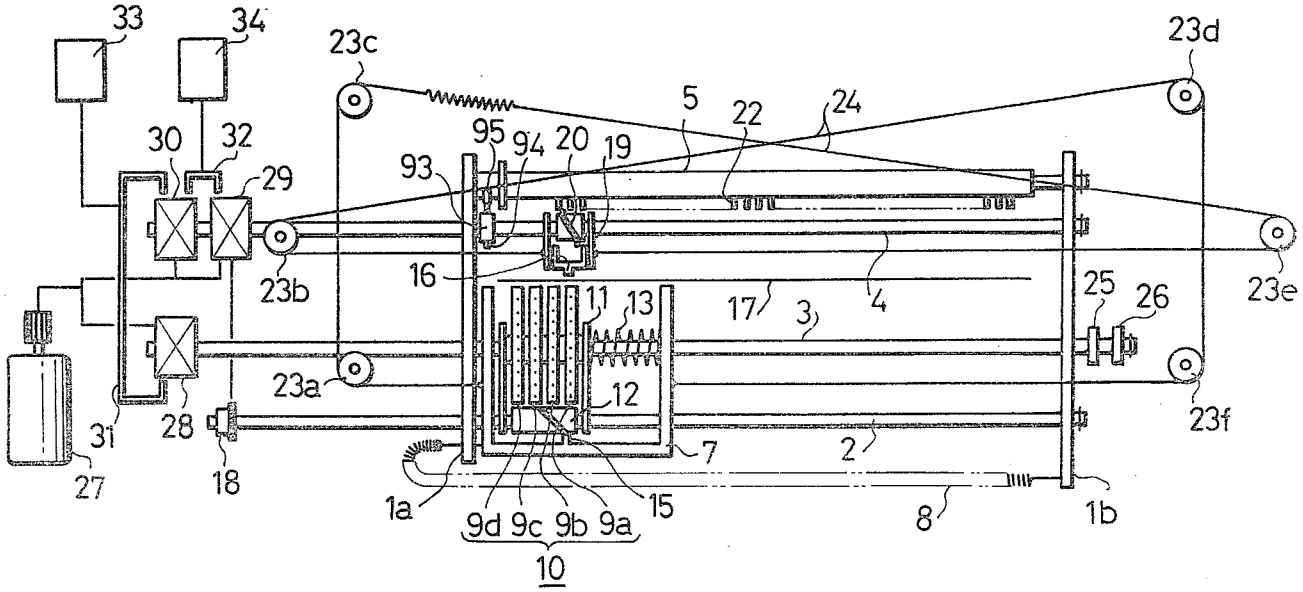
FIG. 1 is a schematic view of a printer embodying the present invention.

FIG. 1 is a view for explaining the schematic construction of a printer according to the invention. The framework of the printer includes side plates 1*a* and 1*b* having a shaft 2 for a type wheel selecting cam 12, a type shaft 3, a print/carry shaft 4 and a rack 5 rotatably installed at predetermined intervals between the side plates. Further, although not shown, a paper feed shaft 6 (refer to FIG. 2) is rotatably installed behind the print/carry shaft 4.

A carriage 7 which is extended across the type wheel selecting cam shaft 2 and the type shaft 3 is held in a manner enabling it to slide along these shafts. Normally, the carriage is resiliently urged onto its home position (feed starting position) close to the side frame 1*a* by a carriage return spring 8. In the carriage 7, a slider frame 11 extended across the type wheel selecting cam shaft 2 and the type shaft 3 is arranged in a manner enabling it to slide along the shafts similarly to the carriage 7. Held in the slider frame 11 are a type wheel group 10 which consists of four type wheels 9*a*–9*d* splined to the type shaft 3, and a type wheel selecting cam 12 which is splined to the type wheel selecting cam shaft 2. The type wheel group 10 as well as the type wheel selecting cam 12 are normally urged toward a reference position on the side of the side plate 1*a* through the slider frame 11 by means of a type wheel group return spring 13 which is loosely fitted on the type shaft 3 between the carriage 7 and the slider frame 11.

Figure 3:
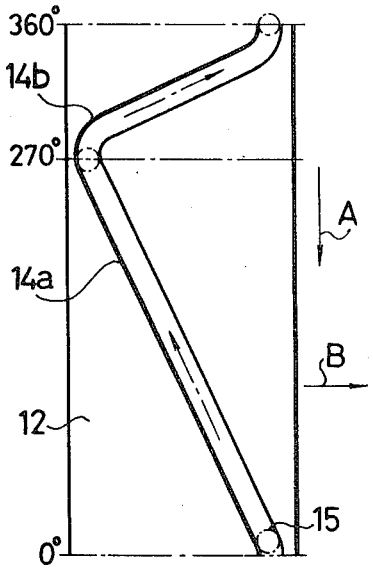
FIG. 3 is a developed view of the cam surface of a type wheel selecting cam.

Since the type wheel selecting cam 12 is splined with the type wheel selecting cam shaft 2 as described before, the former rotates unitarily with the latter and is also slidable in the axial direction of the latter. A cam groove 14 is formed in the outer peripheral surface of the type wheel selecting cam 12. As shown in FIG. 3 which is a developed view of the outer peripheral surface of the type wheel selecting cam 12, the cam groove 14 is constructed of a feed cam groove portion 14*a* and a return cam groove portion 14*b* which are in the form of a modified helix. Both of the cam groove portions 14*a* and 14*b* communicate with each other. The feed cam groove portion 14*a* extends over approximately $\frac{3}{4}$ (0°–270°) of the peripheral surface of the type wheel selecting cam 12, while the return cam groove 14*b* extends over approximately $\frac{1}{4}$ (270°–360°) of the peripheral surface of the cam 12.

As shown in FIG. 1, the carriage 7 is provided with a protrusion 15 which snugly fits in the cam groove 14 of the type wheel selecting cam 12. When the type wheel selecting cam 12 is rotated, the slider frame 11 which holds the type wheel group 10 and the type wheel selecting cam 12 advances or retreats rightward or leftward within the carriage 7 owing to the cooperation between the guide of the protrusion 15 riding in the cam groove 14 and the urging force of the type wheel group return spring 13.

In the initial state, the slider frame 11 is urged to the leftmost side of the carriage 7 by the return spring 13, and the protrusion 15 is in engagement with the cam groove 14 at a position on the lower right end of the feed cam groove 14*a* as shown in FIG. 3. Under this state, the first type wheel 9*a* opposes to a hammer 16 which is disposed in a hammer/carry cam holding member 19 supported by the print/carry shaft 4. The position at which the first type wheel 9*a* confronts the hammer 16 is this manner shall be called the "reference position of the type wheel group 10", and as illustrated in FIG. 1.

Now, when the type wheel selecting cam 12 is rotated 90° in the direction of arrow A indicated in FIG. 3 by means of the type wheel selecting cam shaft 2, the slider frame 11 shifts a predetermined amount in the direction of arrow B indicated in FIG. 3, in other words rightward in FIG. 1, while compressing the type wheel group return spring 13, owing to the guide of the protrusion 15 which is in a fixed state with respect to the type wheel selecting cam 12. At this time, the second type wheel 9*b* opposes the hammer 16. When the type wheel selecting cam 12 is further rotated 90° in the direction of the arrow A; the type wheel group 10, the slider frame 11 and the type wheel selecting cam 12 generally shift a predetermined amount rightward as in the foregoing, and the third type wheel 9*c* opposes the hammer 16. By further rotating the type wheel selecting cam 12 by 90° in the direction of the arrow A, that is by rotating the type wheel selecting cam 12 an angle of 270° from the initiation of the rotation thereof, the type wheel group 10 can be shifted so as to bring the fourth type wheel 9*d* into opposition with the hammer 16. Such movement of the type wheel group 10 is performed while the protrusion 15 is sliding within the feed cam groove 14*a* of the type wheel selecting cam 12. Accordingly, the type wheel 9 to oppose the hammer 16 can be selected by adjusting the rotational angle of the type wheel selecting cam 12 by rotating the type wheel selecting cam shaft 2.

Upon further rotating the type wheel selecting cam 12 in the direction of the arrow A from the state in which the fourth type wheel 9*d* is in opposition to the hammer 16, the protrusion 15 shifts from the feed cam groove portion 14*a* to the return cam groove portion 14*b*. Since the direction of the return cam groove portion 14*b* is reverse to that of the feed cam groove portion 14*a*, the protrusion 15 is returned to the beginning of the feed cam groove portion 14*a* by rotating the type wheel selecting cam 12 an angle of 90° in the direction of the arrow A. That is, owing to the sliding engagement of the protrusion 15 within the return cam groove portion 14*b*, the aggregate consisting of the type wheel group 10, the slider frame 11 and the type wheel selecting cam 12 returns to their initial position shown in FIG. 1, and the first type wheel 9*a* opposes the hammer 16 again. Since the type wheel selecting cam shaft 2 (the type wheel selecting cam 12) rotates only in a fixed direction, the feed and return of the type wheel group 10 are alternately repeated, and the selection of a type wheel 9 is made.

Figure 2:
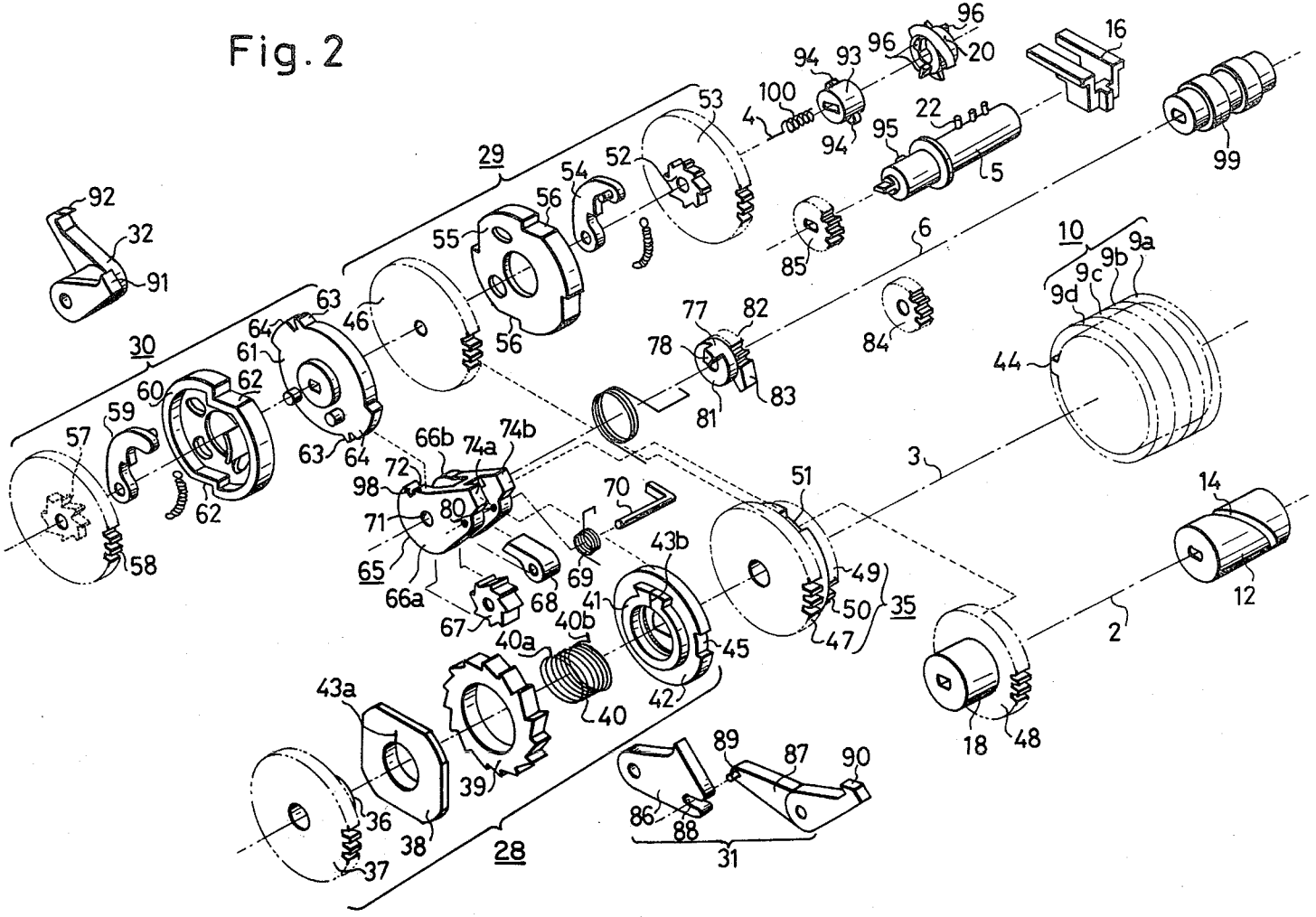
FIG. 2 is an exploded perspective view showing respective clutch means and related structures.

As shown in FIGS. 1 and 2, a type wheel position sensor 18 is fastened at the left end of the type wheel selecting cam shaft 2, and particular type wheel 9 presently in opposition to the hammer 16 or the positional state of the type wheel 9 is indicated by this sensor 18. As shown in FIG. 1, a type position sensor 25 and a type reference position sensor 26 are fastened at the right end of the type shaft 3.

As illustrated in FIG. 1, the hammer/carry cam holding member 19 is slidably held by the print/carry shaft 4, and the hammer 16 and a carry cam 20 are arranged inside the member 19. The carry cam 20 is splined to the print/carry shaft 4, and the hammer 16 is held so that it can be urged outwardly toward the type wheels.

Figure 4:
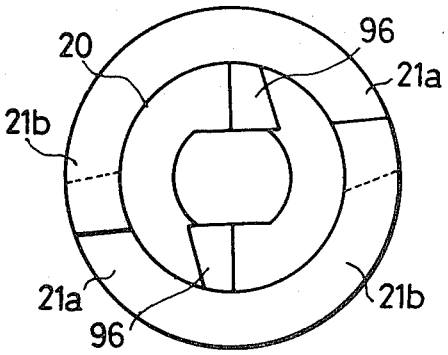
FIGS. 4 and 5 are a plan view and a side view showing a carry cam, respectively.
Figure 5:
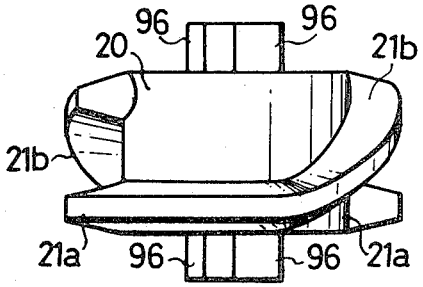
Figure 6:
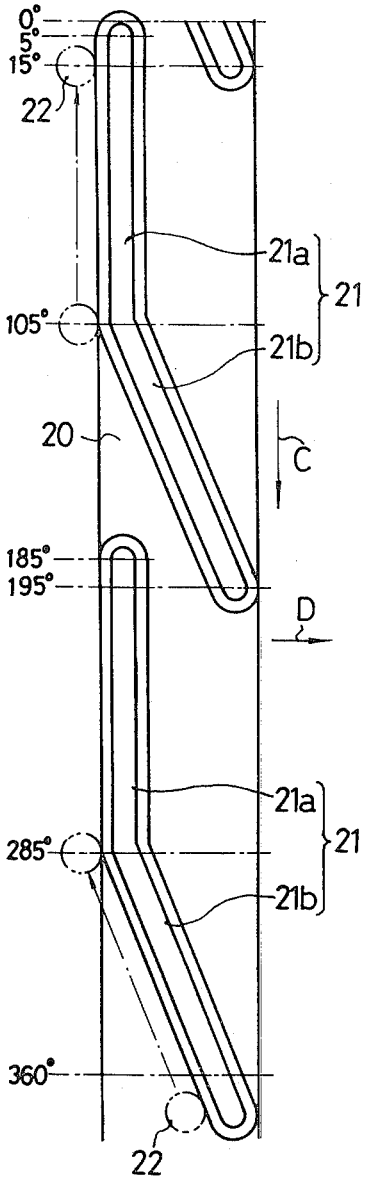
FIG. 6 is a developed view of the cam surface of the carry cam.
Figure 7:
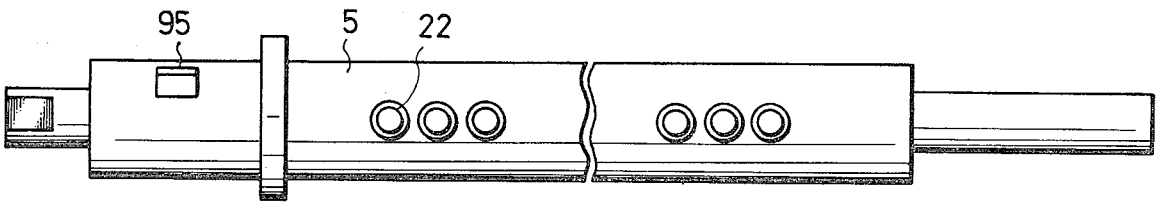
FIGS. 7 and 8 are a plan view and a side view showing a rack, respectively.
Figure 8:
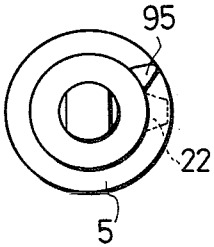

As shown in FIGS. 4, 5 and 6, the carry cam 20 is formed with two protuberances 21 extending over the outer peripheral surface of the carry cam. Each of the protuberances 21 is formed of two portions including a planar circumferential portion 21*a* extending circumferentially around approximately ¼ of the peripheral surface of the carry cam 20, and a helical portion 21*b* which is helically extended around approximately ¼ of the peripheral surface of the carry cam 20. These protuberance portions 21*a* and 21*b* of each protuberance 21 are continuous, and the two protuberances 21 are offset 180° from one another around the surface of the carry cam 20. As shown in FIG. 1, the protuberances 21 of the carry cam 20 are adapted to mesh with rack teeth 22 provided in the rack 5. As shown in FIGS. 7 and 8, the rack teeth 22 are each in the shape of a truncated cone and are spaced at equal intervals in the lengthwise direction of the rack 5.

As illustrated in FIG. 1, the carriage 7 is coupled with the hammer/carry cam holding member 19 by a string element 24 which is stretched over six rollers 23*a*–23*f*. Accordingly, the carriage 7 moves in the same direction the same amount in synchronism with the hammer/carry cam holding member 19. Since the carriage 7 is normally urged onto the home or initial position by the carriage return spring 8 as described before, the protuberances 21 of the carry cam 20 are ordinarily in mesh with the rack teeth 22 in resilient contact therewith under the influence of the force of spring 8. When the print/carry shaft 4 (the carry cam 20) is rotated ¼ revolution in the direction of arrow C as indicated in FIG. 6, the carry cam 20 merely rotates ¼ revolution in its place without being transferred because the rack tooth 22 engaged with protuberance 21 is in sliding contact with the circumferential protuberance portion 21*a* at first. When the print/carry shaft 4 (the carry cam 20) is subsequently rotated ¼ revolution in the direction of the arrow C, the helical protuberance portion 21*b* of the other protuberance 21 now comes into sliding contact with the rack tooth 22 next to the rack tooth 22 having abutted on the circumferential protuberance portion 21*a* previously. With continued rotation, the carry cam 20 moves toward the side plate 1*b* in FIG. 1 or in the direction of arrow D in FIG. 6 an amount substantially corresponding to one digit.

The hammer 16 is arranged in the holding member 19 together with the carry cam 20, while the carriage 7 is coupled with the holding member 19 through the string element 24. Therefore, when the carry cam 20 moves in the direction of the arrow D the amount substantially corresponding to one digit, the carriage 7 and the hammer 16 are thereby transferred in the same direction the same amount.

As illustrated schematically in FIG. 1, the torque of a motor 27 which normally rotates in one direction is transmitted to the type shaft 3 through a type selecting clutch 28, to the type wheel selecting cam shaft 2 through a type wheel selecting clutch 29 and to the print/carry shaft 4 through a print/carry clutch 30. The change from of the transmission of torque by the type selecting clutch 28 to the transmission of torque by the print/carry clutch 30 is properly executed by a first switching member 31, while the change from of the transmission of torque from the type wheel selecting clutch 29 to the transmission of torque from the print/carry clutch 30 is properly executed by a second switching member 32. The first switching member 31 is operated by a first electromagnet 33, and the second switching member 32 by a second electromagnet 34.

In the respective clutches 28, 29 and 30, let "ON" denote the state in which the transmission of torque from the motor 27 is possible, and "OFF" denote the state in which it is impossible. Then, in case where the first electromagnet 33 is not energized (deenergized state), the type selecting clutch 28 turns ON, and in case where the first electromagnet 33 is energized (energized state), the type selecting clutch 28 turns OFF. In addition, in case where the second electromagnet 34 is not energized (deenergized state), the type wheel selecting clutch 29 turns OFF, and in case where the second electromagnet 34 is energized (energized state), the type wheel selecting clutch 29 turns ON. Further, the print/-carry clutch 30 turns ON only in case where the first electromagnet 33 is energized and where the second electromagnet 34 is not energized, and it turns OFF under any other condition.

Now, the construction of the clutches and other parts associated therewith will be described with reference to FIG. 2.

Assembled to the type shaft 3 are the type wheel group 10, the type selecting clutch 28, and an intermediate torque transmission member 35 which transmits torque from the type wheel selecting clutch 28 to the type wheel position sensor 18 mounted to rotate integrally with the type wheel selecting cam shaft 2.

The type selecting clutch 28 consists of a driving gear 37 which is protrusively provided with a cylindrical hub portion 36 on the central part of one side surface thereof, a spring-fixing ring 38, a ratchet 39 for selecting a type position, a coiled spring 40, and a releasing cam 42 which is protrusively provided with an annular portion 41 on the central part of one side surface thereof which fits over the cylindrical hub portion 36 of the annular portion.

One end 40*a* of the coiled spring 40 is fitted in and engaged with an engaging slot 43*a* provided in the spring-fixing ring 38, while the other end 40*b* is fitted in and engaged with an engaging slot 43*b* provided in the annular portion 41 of the releasing cam 42. The coiled spring 40 is closely wound round the cylindrical hub portion 36 of the driving side gear 37, and this cylindrical hub portion 36 is inserted into the central hole of the spring-fixing ring 38, the central hole of the ratchet 39 and the annular portion 41 of the releasing cam 42. Thus, the spring clutch connects the driving gear 37 loosely fitted on the type shaft 3 and the releasing cam 42.

More specifically, a sectoral protrusive portion (refer to FIG. 2) provided in the annular portion 41 of the releasing cam 42 is held in engagement with a sectoral notch provided in a side surface of the ratchet 39 (however, the sectoral protrusive portion and notch have a minute clearance in the rotary direction therebetween, the clearance corresponding to the so-called slackening angle of a spring). The three components 38, 39 and 42 are coupled through the coiled spring 40 and turn unitarily with the driving gear 37 when the coiled spring 40 tightly grips the cylindrical hub portion 36 of the driving gear 37. However, as soon as the ratchet 39 has its rotation checked, as will be described below, the coiled spring 40 loosens its grip on the cylindrical hub portion 36, and the rotation of the driving gear 37 is not transmitted.

The number of teeth of the type position selecting ratchet 39 corresponds to the number of type portions 44 which are disposed on the outer periphery of each type wheel 9. The releasing cam 42 is press fitted on the type shaft 3, and is adapted to rotate unitarily therewith. It is formed with a releasing groove 45 in one place of a circumferential cam surface provided at its outer periphery. Among the type portions 44 at the outer periphery of the selected type wheel 9, only one is a so-called blank portion provided with no type element. The area of the releasing groove 45 in the releasing cam 42 corresponds to the area of the blank portion.

The intermediate torque transmission member 35 is loosely fitted on the type shaft 3. It is constructed of a first intermediate transmission gear 47 which meshes with a driven gear 46 of the type wheel selecting clutch 29, a second intermediate transmission gear 49 which meshes with a sensor gear 48 integrally connected with the type wheel position sensor 18, and a type wheel releasing cam 50 which is disposed between these gears 47 and 49. The three components 47, 49 and 50 rotate unitarily. The number of teeth in the first intermediate transmission gear 47 is equal to that in the driven gear 46, while the number of teeth in the second intermediate transmission gear 49 is equal to that in the sensor gear 48. Accordingly, when the driven gear 46 of the type wheel selecting clutch 29 rotates ¼ revolution, the intermediate torque transmission member 35 rotates ¼ revolution. Further, the type wheel position sensor 18 similarly rotates ¼ revolution, and the rotating directions of the driven gear 46 and the type wheel position sensor 18 are identical. A type wheel releasing groove 51 is formed in one place of a circumferential cam surface provided at the outer periphery of the type wheel releasing cam 50.

The type wheel selecting clutch 29 assembled to the print/carry shaft 4 is constructed of a driving gear 53 which is protrusively provided with a hub portion having a ratchet 52, a turnable engaging pawl 54 which engages the ratchet 52, a control plate 55 for selecting a type wheel, and the driven gear 46. All of the driving gear 53, the control plate 55 and the driven gear 46 are held in a manner to be rotatable separately from the print/carry shaft 4. The type wheel selecting control plate 55 has a circumferential cam surface formed with notches 56 at equal intervals. The notches 56 are provided in the same number as that of the type wheels 9, and the number is four in this embodiment. The type wheel selecting clutch 29 is formed by a so-called jaw clutch. A pin (not shown) protruded from the side surface of the driven gear 46 is passed through one of the holes formed through the side wall of the control plate 55, and is fitted and fastened in an aperture at the center of rotation of the engaging pawl 54. A pin at the fore end of the engaging pawl 54 is held in the other hole of the control plate 55 so as not to fall off. Thus, the three components 46, 54 and 55 are adapted to turn unitarily. Owing to a spring whose one end is held in engagement with the pin of the engaging pawl 54 and whose other end is held in engagement with the driven gear 46, the pawl portion of the engaging pawl 54 is held in resilient contact with the ratchet 52 unitary with the driving gear 53. Accordingly, in the state in which an engaging member to be described later is not fitted in the notch 56 of the control plate 55 on the driven side, the rotation of the driving gear 53 is transmitted to the driven gear 46 through the engaging pawl 54 held in engagement with the ratchet 52. On the other hand, when the engaging member is fitted in a notch 56 of the control plate 55 to check the rotation thereof, the engaging pawl 54 having been held in engagement with the ratchet 52 comes away from the ratchet 52 against the resiliency of the spring, and the transmission of rotation between the driving gear and the driven gear becomes impossible.

The print/carry clutch 30 assembled to the print/carry shaft 4 is constructed of a driving gear 58 which is protrusively provided with a hub having a ratchet 57, a turnable engaging pawl 59 which is adpated to engage the ratchet 57, a print/carry control plate 60, and a control lever locking member 61. The driving gear 58 and the print/carry control plate 60 are loosely fitted on the print/carry shaft 4, and only the control lever locking member 61 rotates unitarily with the print/carry shaft 4. That is, the print/carry clutch 30 is also a jaw clutch similar to the type wheel selecting clutch 29 stated previously. The driven side is assembled so that the three components 59, 60 and 61 may turn unitarily with the engaging pawl 59 urged into engagement with the ratchet 57 of the driving gear 58 by a spring, and the operating state ("on" or "off") of the clutch is controlled by an engaging member to be described later which may engage any of notches 62 formed at the outer periphery of the print/carry control plate 60.

The circumferential surface of the print/carry control plate 60 forms a cam provided with two notches 62 at intervals of 180°. The outer periphery of the control lever locking member 61 is provided with kickup tooth portions 63 at intervals of 180°. Further, arcuate locking portions 64 are respectively formed behind each kickup tooth portion 63 as viewed in the rotary direction and in a manner to be somewhat spaced therefrom. The outer peripheral edge of each locking portion 64 conforms to the addendum circle of each kickup tooth portion 63. The outer peripheral parts of the control lever locking member 61 other than the kickup tooth portions 63 and the locking portions 64 are indented with respect to these portions, and conform to the dedendum circle of the pickup tooth portions 63.

The control lever locking member 61 is adapted to engage a carriage return/paper feed control lever 65 which is loosely fitted on the paper feed shaft 6. The control lever 65 is constructed of a lever body 66 which is rotatably supported on the paper feed shaft 6, a paper feed shaft-driving ratchet 67 which is inserted in the hollow portion of the lever body 66 and which rotates unitarily with the paper feed shaft 6, a pawl piece 68, an urging spring 69, and a supporting pin 70.

The lever body consists chiefly of a first lever piece 66*a* and a second lever piece 66*b* which are substantially in the same shape. Both the lever pieces 66*a* and 66*b* are unitarily molded with a predetermined spacing therebetween. As shown in FIGS. 2, 9, 10 and 11, penetrating holes 71 through which the paper feed shaft 6 is loosely fitted are respectively provided at the turning centers of both the lever pieces 66*a* and 66*b*.

Figure 9:
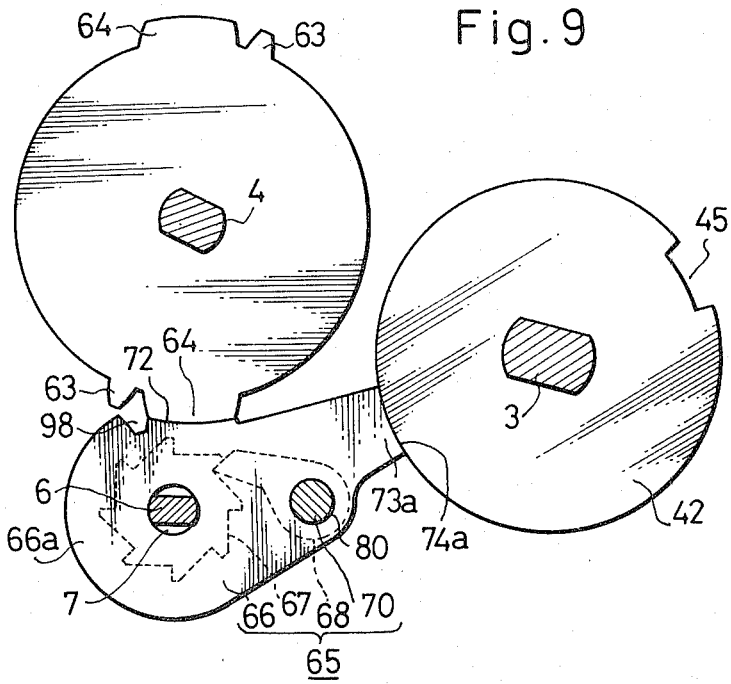
FIGS. 9, 10, and 11 are explanatory views showing operating states for a control lever locking member, a first lever piece and a type side releasing cam.

That side surface of the first lever piece 66*a* which opposes the control lever locking member 61 is provided with a fitting face 72 which is an arcuate recess having a radius of curvature equal to that of the outer periphery of the locking portion 64 in the control lever locking member 61. Unless a print/carry operation is proceeding, the locking portion 64 is held within in the fitting face 72 as illustrated in FIG. 9. Further, a sliding contact face 74*a* which is an arcuate recess having a radius of curvature equal to that of the outer periphery of the releasing cam 42 is provided at the fore end of a free end 73*a* in the first lever piece 66*a*. Normally, with the rotation of the releasing cam 42, the outer peripheral cam surface thereof and the sliding contact face 74*a* are in sliding contact as illustrated in FIG. 9.

In addition, a sliding contact face 74*b* which is an arcuate recess having a radius of curvature equal to that of the outer periphery of the type wheel releasing cam 50 is provided at the fore end of a free end 73*b* of the second lever piece 66*b*. Normally, with the rotation of the type wheel releasing cam 50, the outer peripheral cam surface thereof and the sliding contact face 74*b* are in sliding contact as illustrated in FIG. 12

Figure 12:
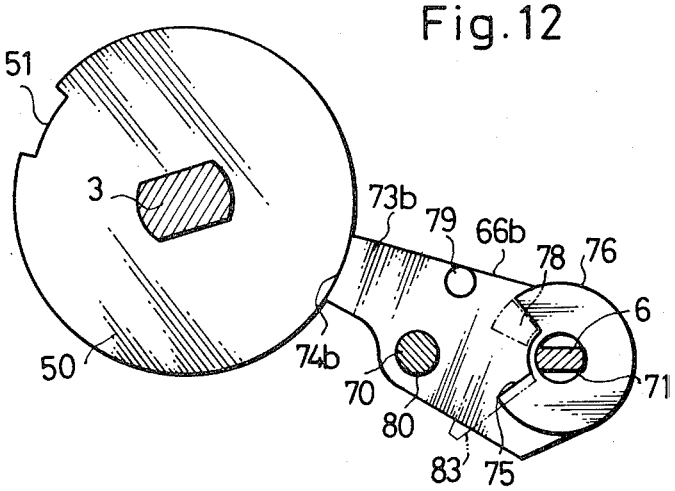
FIGS. 12 and 13 are explanatory views showing operating states for a second lever piece and a type wheel shift side releasing cam.
Figure 13:
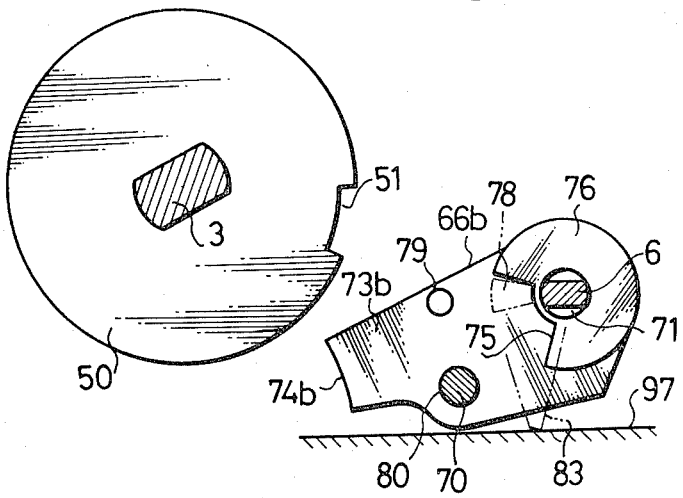

As shown in FIGS. 12 and 13, a tubular member 76 which has a notch 75 formed in its part is protrusively provided on the central part of the outside surface of the second lever piece 66*b*. An engaging projection 78 of a rack releasing transmission member 77 to be described later is inserted in the notch 75. A pin 79 is protrusively provided on the outside surface of the second lever piece 66*b*. By resiliently pressing the pin 79 downward with a spring, the carriage return/paper feed control lever 65 is urged clockwise as viewed in FIG. 9.

As shown in FIG. 2 and FIGS. 9 to 13, inserting holes 80 in which the supporting pin 70 is inserted are respectively provided on the sides of the free ends 73*a* and 73*b* of the first lever piece 66*a* and the second lever piece 66*b*. The pawl piece 68 is turnably supported by the supporting pin 70 inserted in the holes 80, the fore end of the pawl piece 68 engages the tooth portion of the paper feed shaft driving ratchet 67, and the pawl piece 68 is normally urged resiliently by the urging spring 69 in the direction for engaging the ratchet 67.

Figure 14:
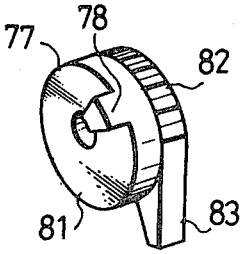
FIG. 14 is a perspective view of rack releasing transmission member.

As shown in FIGS. 2 and 14, the rack releasing transmission member 77 consists principally of an annular portion 81 and a gear portion 82. The aforecited engaging projection 78 is provided on the side surface of the annular portion 81, and a stopper 83 is projected substantially in a tangential direction from the gear portion 82. The rack releasing transmission member 77 is loosely fitted on the paper feed shaft 6, and is partly engaged with the carriage return/paper feed control lever 65 by inserting the engaging projection 78 in the notch 75 of the lever 65 (refer to FIGS. 12 and 13).

The gear portion 82 of the rack releasing transmission member 77 meshes with an idler gear 84 shown in FIG. 2. Further, the idler gear 84 meshes with a rack releasing gear 85, which rotates unitarily with the rack 5.

As shown in FIG. 2, the first switching member 31 is constructed of a pressing lever 86 and a pawl piece member 87. The pressing lever 86 has its base part turnably supported, and has its free end side held in resilient contact with the circumferential cam surface of the print/carry control plate 60 by spring means (not shown). The free end of the pressing lever 86 is formed with an engaging groove 88, in which a connecting pin 89 of the pawl piece member 87 is inserted. The pawl piece member 87 has its intermediate part turnably supported. The connecting pin 89 is formed at one end of the pawl piece member 87, while an engaging pawl 90 which meshes with the tooth portion of the type position selecting ratchet 39 is provided at the other end.

The second switching member 32 has its intermediate part turnably supported. The aforecited engaging member or engaging pawl 91 which engages the notch 62 of the print/carry control plate 60 is provided at one end of the second switching member 32, while the aforecited engaging member of engaging pawl 92 which engages the notch 56 of the type wheel selecting control plate 55 is provided at the other end.

Figure 15:
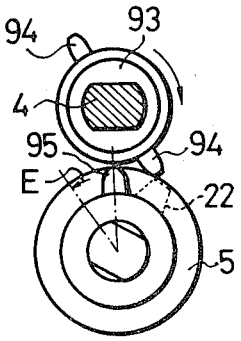
FIG. 15 is an explanatory view showing an operating state of a rack returning member, FIGS. 16(*a*), 16(*b*) and 16(*c*) are explanatory views showing operating states of the clutches.

As shown in FIG. 1, a rack returning member 93 which is splined to the print/carry shaft 4 is held near the inner surface of the side plate 1*a* on the print/carry shaft 4. As shown in FIGS. 2 and 15, the rack returning member 93 is protrusively provided with two pushing teeth 94 spaced at an interval of 180° on its outer periphery. On the other hand, a single receiving tooth 95 which is engageable with either pushing tooth 94 is protrusively provided on the outer periphery of the end part of the rack 5. The rack returning member 93 is urged by a spring 100 rightward and upward as viewed in FIG. 2. When the hammer 16 as well as the carry cam 20 has returned to its home position, the rack returning member 93 is pressed against the spring 100 leftward and downward in FIG. 2, and its pushing tooth 94 opposes the receiving tooth 95 of the rack 5.

Figure 16A:
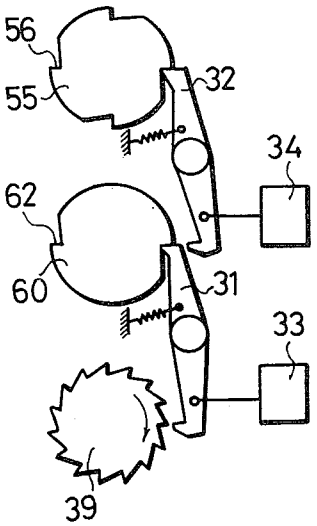
Figure 16B:
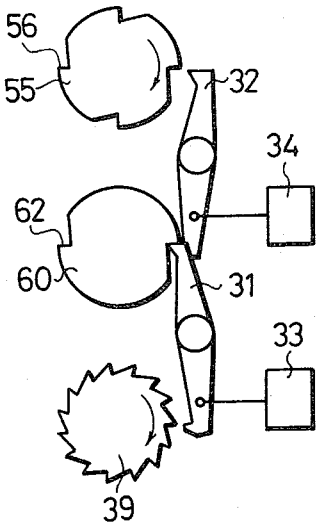
Figure 16C:
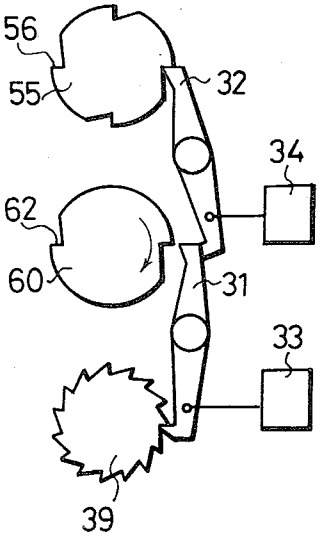
Figure 17:
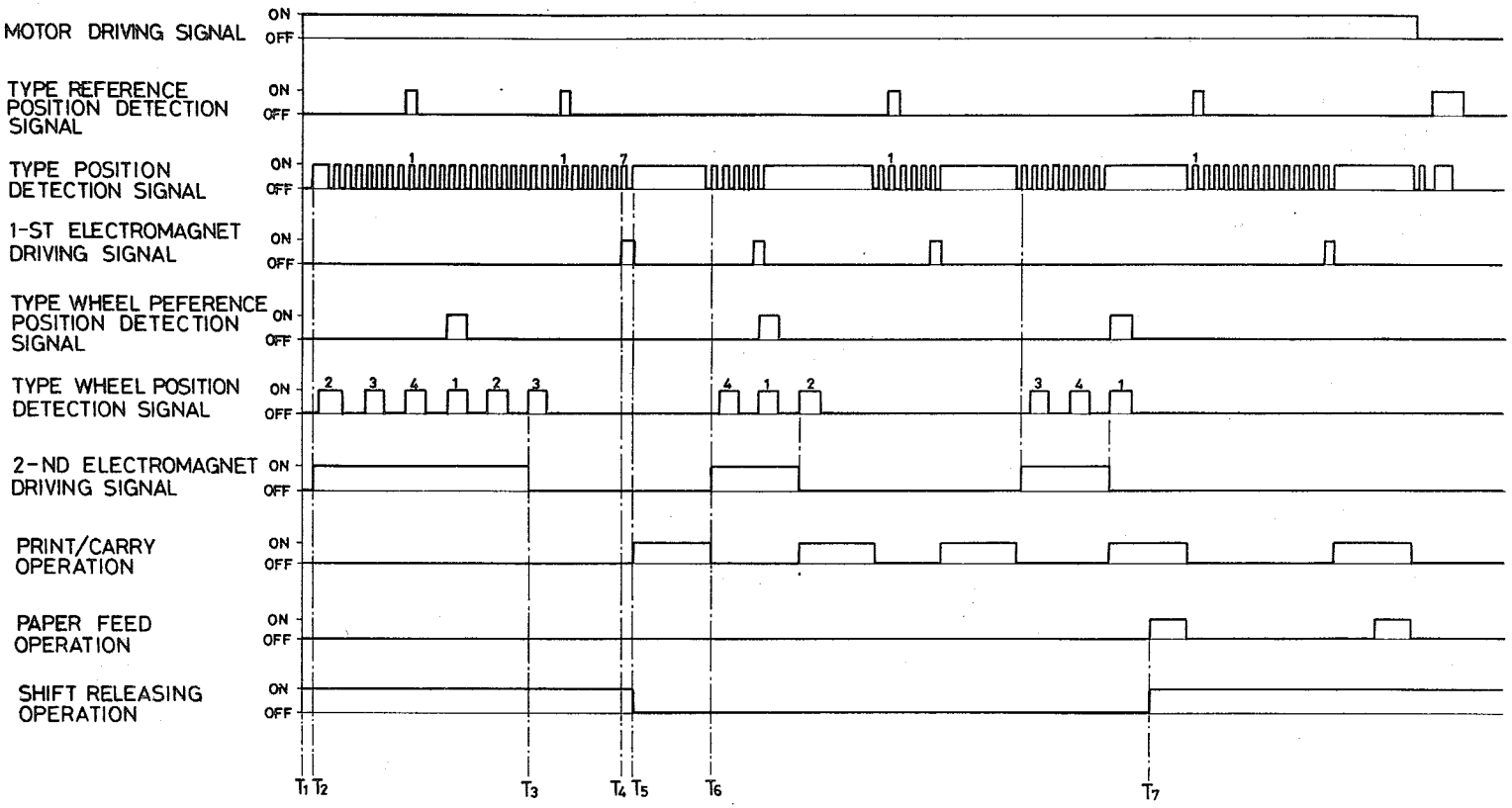
FIG. 17 is a timing chart of various output signals and operations.

Now, the operating sequence of this printer will be described. FIGS. 16(*a*), 16(*b*) and 16(*c*) are views for explaining the operating states of the respective clutches. FIG. 17 is a timing chart of various output signals and operations.

In the state in which the printing of one line is started, as illustrated in FIG. 1, the carriage 7 is standing by at the home position owing to the carriage return spring 8, and the type wheel group 10 within the carriage 7 is standing by at the reference position owing to the type wheel group return spring 13. In the stand-by state, the motor 27 begins to rotate on the basis of the command of printing one line from a control unit (not shown) (a time $T_1$ in FIG. 17). In the initial state, neither the first electromagnet 33 nor the second electromagnet 34 is energized. As shown in FIG. 16(*a*), therefore, the first switching member 31 engages the print/carry control plate 60, the second switching member 32 engages the type wheel selecting control plate 55, and the type position selecting ratchet 39 is out of engagement with the first switching member 31. Accordingly, the type wheel selecting clutch 29 and the print/carry clutch 30 are in the OFF states, and the type selecting clutch 28 is in the ON state. Consequently, the power of the motor 27 is transmitted to only the type shaft 3, and only this shaft is rotating. With the rotation of the type shaft 3, the outer peripheries of the respective type wheels 9*a*–9*d* are coated with ink by an ink roller (not shown) carried on the carriage 7.

Before the rotation of the motor 27, the rack 5 is turned somewhat clockwise as shown in FIG. 15. The rack teeth 22 move downwardly as indicated by a broken line, and are away from the protuberances 21 of the carry cam 20. The rack 5 and the carry cam 20 are out of engagement, and the receiving tooth 95 opposes the rack returning member 93.

With the rotation of the type shaft 3 as described above, a type position detection signal is delivered from the type position sensor 25 and a type reference position signal from the type reference position sensor 26 as illustrated in FIG. 17. When the rotation of the type shaft 3 is continued, the type reference position signals are periodically provided. Before the next type reference position signal is provided, 15 pulses of the type position detection signals are delivered. This number of the pulses coincides with the number of the type portions (including the blank portion) of the type wheel 9, and the type position detection signals are provided 15 times or so in this embodiment.

When the first type position detection signal is provided at a time $T_2$ in FIG. 17, the second electromagnet 34 is energized on the basis of the signal, so that the second switching member 32 turns against the resilience of the urging spring. This turning results in releasing the engagement between the second switching member 32 and the type wheel selecting control plate 55 as shown in FIG. 16(*b*) and in bringing the type wheel selecting clutch 29 into the ON state. Thus, the rotation driving force of the motor 27 is successively transmitted to the driving gear 53 shown in FIG. 2, the type wheel selecting control plate 55, the driven gear 46, the intermediate torque transmission member 35 meshing with the driven gear 46, the type wheel position sensor 18 meshing with the intermediate torque transmission member 35, and the type wheel selecting cam shaft 2 engaging the type wheel position sensor 18. These components with the power transmitted thereto are rotated. On the basis of the rotation of the type wheel selecting cam shaft 2, a type wheel reference position sensor (not shown) and the type wheel position sensor 18 which rotate unitarily with the shaft 2 provide a type wheel reference position detection signal and a type wheel position detection signal as shown in FIG. 17, respectively.

The type wheel selecting cam 12 rotates together with the type wheel selecting cam shaft 2. Thus, the type wheel group 10 is gradually shifted to the right in FIG. 1 against the resilience of the type wheel group return spring 13, and the type wheels 9 opposing the hammer 16 change in succession.

Owing to the rotations of the type wheel selecting cam shaft 2 and the type shaft 3, the type wheel 9 which possesses a desired type to be printed is selected, and the desired type or a type of another type wheel 9 located on the same bus is selected. The sequence of the shift selection of the type wheels 9 (the selection of the slide position in the direction of the arrow D) and the type selection or the selection of the rotation stopping position of the type wheel group 10 is at will. The shift selection and the rotation stopping position-selection are successively performed though the sequence differs depending upon the position of the type to be selected or the ratio of transfers from the motor 27 to the type wheel selecting cam shaft 2 and the type shaft 3.

Supposing by way of example that the type wheel 9*c* is selected. At a time $T_3$ in FIG. 17, a second electromagnet driving signal is turned OFF by the rise of the corresponding type wheel position detection signal. Thus, the supply of electric power to the second electromagnet 34 is cut off. The second switching member 32 returns to the original state owing to the restoring force of the urging spring, and comes into engagement with the type wheel selecting control plate 55. In contrast, it comes away from the print/carry control plate 60 and is disengaged therefrom as shown in FIG. 16(*a*). At this time $T_3$, accordingly, the type wheel selecting clutch 29 turns OFF to stop the rotation of the type wheel selecting cam shaft 2, but the type shaft 3 continues to rotate. The type wheel position detection signal having risen at the time $T_3$ is the third signal as reckoned from the type wheel reference position detection signal provided before it. Therefore, the shift in the direction of the arrow D is stopped in the position where the third type wheel 9*c* (refer to FIG. 1) oppose the hammer 16, and the type wheel group 10 is rotating in that position.

Thereafter, when the type has been selected, that is, the rotation stopping position of the type wheel group 10 has been selected at a time $T_4$, a first electromagnet driving signal is provided at the rise of the type position detection signal, and the first electromagnet 33 is energized by the driving signal. Thus, the first switching member 31 turns against the resilience of the urging spring and comes away from the print/carry control plate 60 to be disengaged therefrom. On the other hand, the first switching member 31 comes into engagement with the type position selecting ratchet 39.

At this time $T_4$, accordingly, as shown in FIG. 16(*c*), the type position selecting ratchet 39 (type selecting clutch 28) and the type wheel selecting control plate 55 (type wheel selecting clutch 29) fall into the OFF states, and the print/carry control plate 60 (print/carry clutch 30) falls into the ON state. The type wheel group 10 is stopped in the state in which the desired type oppose the hammer 16. Since the type position detection signal having risen at the time $T_4$ is the seventh signal as reckoned from the type reference position detection signal provided before it, the seventh type portion as reckoned from a type reference position previously determined for the type wheel 9 is in opposition to the hammer 16. Since the first electromagnet driving signal turned ON at the time $T_4$ is turned OFF at the rise (time $T_5$) of the next type position detection signal, the energization of the first electromagnet 33 is instantaneous, and the engagement between the print/carry control plate 60 and the first switching member 31 is released meanwhile. Subsequently, a print/carry operation begins.

When the first switching member 31 has come away from the notch 62 of the print/carry control plate 60, the print/carry control plate 60, the control lever locking member 61, the print/carry shaft 4 which is held in engagement with the control lever locking member 61, and the rack returning member 93 and the carry cam 20 which are splined with the print/carry shaft 4 are rotated. When the supply of electric power to the first electromagnet 33 has been cut off after the initiation of the rotation, the first switching member 31 has its one end brought into resilient contact with the circumferential cam surface of the print/carry control plate 60 by the restoring force of the urging spring. Therefore, before the print/carry control plate 60, the print/carry shaft 4 etc. rotate a half revolution, their rotations are not checked by the first switching member 31.

At the initial state of the rotation of the rack returning member 93, the pushing tooth 94 disposed therein pushes the receiving tooth 95 of the rack 5 in the direction of arrow E as illustrated in FIG. 15. Thus, the rack teeth 22 having previously been turned downwardly are returned to the position opposite the carry cam 20, and they mesh with the protuberances 21 of the carry cam 20. Then, as illustrated in FIG. 17, a shift releasing operation ends, and a shiftable state is established.

Also the carry cam 20 rotates synchronously. Since, however, the circumferential protuberance 21*a* is in sliding contact with the rack tooth 22 during the first ¼ revolution as described before, the carry cam 20 rotates in its place without moving. As shown in FIGS. 2, 4 and 5, each of the two end faces of the carry cam 20 is provided with two hammer thrusting protrusive pieces 96 at an interval of 180°. In the first ¼ revolution of the carry cam 20, accordingly, the hammer 16 is thrust toward the type wheel 9 against the resilience of a hammer returning spring (not shown) by the hammer thrusting protrusive pieces 96, and the paper 17 is brought into pressed contact with the type portion opposing to the hammer 16, so that the printing is executed.

In the subsequent ¼ revolution of the carry cam 20, the hammer thrusting protrusive pieces 96 come away from the hammer 16, and the hammer 16 is returned to the original position by the restoring force of the hammer returning spring. Simultaneously therewith, the helical protuberance 21*b* of the carry cam 20 now comes into sliding contact with the rack tooth 22. With the rotation of the carry cam 20, the hammer/carry cam holding member 19 is shifted a distance corresponding to one digit in the direction of the arrow D in FIG. 1. As the hammer/carry cam holding member 19 moves, the hammer 16, the carriage 7, the type wheel group 10, the slider frame 11, the type wheel selecting cam 12 etc. are shifted together in amounts corresponding substantially to one digit in the direction of the arrow D, to make ready for the next printing.

Although the control lever locking member 61 rotates a half revolution in the print/carry operation as stated before, the sliding contact face 74*a* of the first lever piece 66*a* abuts on the circumferential cam surface of the stopped type side releasing cam 42 as illustrated in FIG. 9 and the sliding contact face 74*b* of the second lever piece 66*b* abuts on the circumferential cam surface of the stopped type wheel shift side releasing cam 50 as illustrated in FIG. 12. Therefore, even when the locking portion 64 of the control lever locking member 61 has fallen from the fitting face 72 of the first lever piece 66*a*, the carriage return/paper feed control lever 65 is held in its position without turning.

When the print/carry control plate 60, the control lever locking member 61, the print/carry shaft 4 etc. have rotated a half revolution as stated above, one end of the first switching member 31 falls into the notch 62 of the print/carry control plate 60 and stops their rotations. Simultaneously, the other end of the first switching member 31 comes away from the type position selecting ratchet 39 to restore the state of FIG. 16(*a*). Only the type selecting clutch 28 (the type position selecting ratchet 39) falls into the ON state, and the second electromagnet driving signal is provided at the rise of the first type position detection signal (a time $T_6$ in FIG. 17). By successively repeating the shift selection and rotation stopping position selection of the type wheels 9, the printing and the carry in this manner, the printing for one digit is executed.

Now, a carriage return/paper feed operation will be described. In the case of carrying out the carriage return/paper feed operation, the shift selection and rotation stopping position selection of the type wheels 9 are made in response to an operation command from the control unit so that the releasing groove 45 of the type side releasing cam 42 may oppose the sliding contact face 74*a* of the first lever piece 66*a* and that the releasing groove 51 of the type wheel shift side releasing cam 50 may oppose the sliding contact face 74*b* of the second lever piece 66*b*. When, in this manner, the releasing groove 45 and the releasing groove 51 have opposed the sliding contact face 74*a* and the sliding contact face 74*b* respectively, the engagement between the intermediate torque transmission member 35 and the carriage return/paper feed control lever 65 is released. At this point of time, however, the control lever locking member 61 stops in the state in which its locking portion 64 fits on the fitting face 72 of the first lever piece 66*a*. Therefore, the carriage return/paper feed control lever 65 is locked and prevented from rotating by the control lever looking member 61.

Figure 10:
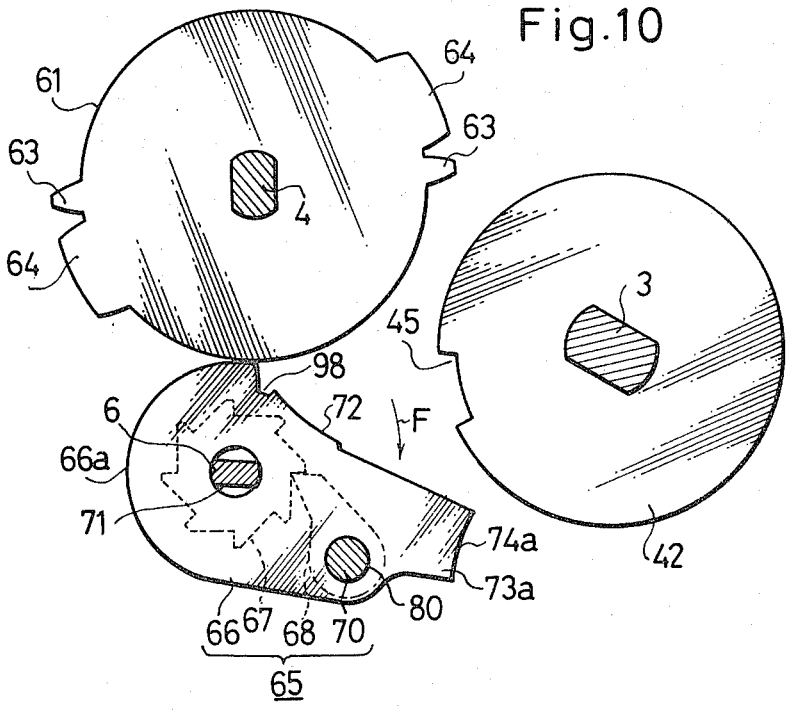

When the control lever locking member 61 has rotated on the basis of a print/carry signal, the locking portion 64 comes away from the fitting face 72 of the first lever piece 66*a* and the indented outer peripheral portion of the control lever locking member 61 opposes the first lever piece 66*a* as illustrated in FIG. 10. Therefore, the carriage return/paper feed control lever 65 having lost the anchoring means is turned in the direction of arrow F by the pressure of the urging spring. Since, at this time, the engaging projection 78 of the rack releasing transmission member 77 abuts on the tubular portion 76 of the second lever piece **66*b* as shown in FIGS. 12 and 13, the rack releasing transmission member 77 is pushed and turned together with the carriage return/paper feed control lever 65. When the stopper 83 of the rack releasing transmission member 77 has abutted on an appropriate stopper piece 97 (refer to FIG. 13), the turning of the carriage return/paper feed control lever 65 as well as the rack releasing transmission member 77** stops.

As the rack releasing transmission member 77 turns, the idler gear 84, the rack releasing gear 85 and the rack 5 shown in FIG. 2 rotate, whereby the engagement between the rack tooth 22 and the protuberance 21 of the carry cam 20 is released (a time $T_7$ in FIG. 17). When the engagement between the rack 5 and the carry cam 20 has been released, the carriage 7, the type wheel group 10, the slider frame 11, the type wheel selecting cam 12, the hammer 16, the hammer/carry cam holding member 19, the carry cam 20 etc. are reset to the home position by the tensile force of the carriage return spring 8. Even when they have returned to the home position, the rack 5 is held in the turned state. With the resetting of the hammer/carry cam holding member 19, the rack returning member 93 slides to bring its pushing tooth into opposition to the receiving tooth 95 of the rack 5 as stated previously.

As illustrated in FIG. 10, when the carriage return-/paper feed control lever 65 turns in the direction of the arrow F about the paper feed shaft 6, the paper feed shaft driving ratchet 67 is supported by the paper feed shaft 6 and is therefore held in its state without turning. As the carriage return/paper feed control lever 65 turns, the fore end part of the pawl piece 68 supported thereon gets over the ratchet tooth immediately behind the ratchet tooth of the ratchet 67 having been engaged till then and comes into engagement with the former ratchet tooth.

Figure 11:
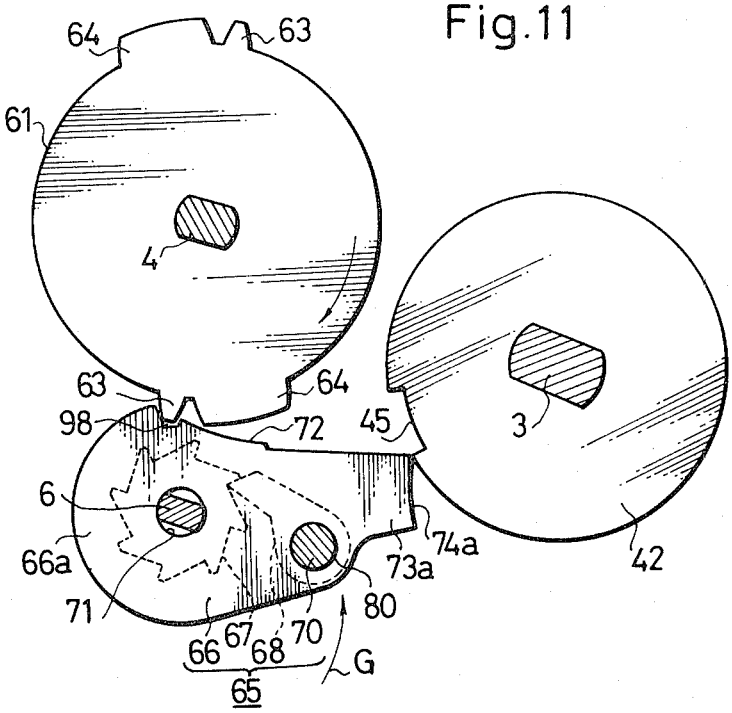

When the control lever locking member 61 has rotated as shown in FIG. 11 on the basis of the subsequent print/carry operation, its kickup tooth portion 63 fits in a concave 98 which is provided next the fitting face 72 of the control lever 65. When the control lever locking member 61 has subsequently rotated, the control lever 65 is turned in the direction of arrow G by the kickup tooth portion 63 to revert into the original state. The control lever 65 is locked again with the locking portion 64 of the control lever locking member 61 abutting on the fitting face 72 of the control lever 65.

When the control lever 65 turns in the direction of the arrow G as stated above, the pawl piece 68 supported thereon causes the paper feed shaft driving ratchet 67 to rotate. The paper feed shaft 6 is press fitted in and fastened to the ratchet 67. Further, a paper feed roller 99 made from rubber is coupled with the paper feed shaft 6 as shown in FIG. 2. Therefore, the rotation of the paper feed shaft driving ratchet 67 results in rotating the paper feed roller 99 and feeding the paper 17 a predetermined amount.

While the carriage return and paper feed operation is executed in this manner, the rack 5 is held disengaged from the carry cam 20. As shown in FIGS. 12 and 13, the notch 75 of the tubular portion 76 in the second lever piece **66*b* is formed into the spread angle, and the engaging projection 78 of the rack releasing transmission member 77 having a small width is loosely fitted therein. Therefore, even when the carriage return/paper feed control lever 65 has been restored to the original position by the turning in the direction of the arrow G, the rack releasing transmission member 77** remains in its state without being reset.

The rack 5 and the rack releasing transmission member 77 are reset at the first printing in the next line. More specifically, the rack 5 is returned to the position opposite to the carry cam 20 by the turning of the rack returning member 93 at the initial stage of the print/carry operation as described before. In addition, the rack releasing transmission member 77 is restored into the original state through the rack releasing gear 85 as well as the idler gear 84 by the turning of the rack 5, and it becomes engageable with the tubular member 76 of the second lever piece **66*b***.

In case of the carriage return, the rack 5 is turned to be disengaged from the carry cam 20, thereby to carry out the carriage return. Even when the carriage return has ended, the rack 5 is held in the turned state. By the first print/carry operation of the next line, the rack 5 is restored to the original position so as to mesh with the carry cam 20.

For the purpose to further enhance the degree of alignment of each print column to be printed on the paper 17, the play for the shafts 2, 3 and 4 of the carriage 7, the type wheel group 10, the carry cam 20 etc. is reduced to the utmost. For example, in case of using the printer at a low temperature, this fact leads to the disadvantage that the return of the carriage 7, the type wheel group 10, the carry cam 20 etc. are inferior and that the carriage return operation takes a long time. When the rack 5 is restored to the original position before the end of the carriage return, the carry cam 20 gets engaged with an intermediate part of the rack 5, and the printing position on the paper 17 becomes different.

With the construction as in this embodiment, there is an allowance in time between the initiation of the carriage return and the restoration of the rack 5 to the original position. Therefore, after the carriage 7, the carry cam 20 etc. have been perfectly reset to the home position, the rack 5 can be turned to mesh with the carry cam 20, and the drawback mentioned above is eliminated.

As set forth above, the printer according to the present invention is provided with return control means for a type carrier and actuates return means by utilizing the operation of carry means. Therefore, the printer can be structurally simplified and miniaturized and can print a large number of symbols, for example, alphanumeric characters. What is claimed is:

1. A printer comprising a carriage adapted to be shifted along a line to be printed and carrying a plurality of type wheels each having a plurality of type elements spaced around respective areas of its circumference, selection means connected with said type wheels for rotating them and shifting them laterally within said carriage for bringing a respective area of any one of said type wheels into a printing position, impact means including a hammer movable along a line to be printed to bring said hammer into a printing position opposite the selected area for impacting a record medium between said hammer and any type element in said printing position, carry means interconnecting said impact means and said carriage for moving them unitarily along the line to be printed, return means for returning said carriage and said impact means to their initial position for the start of printing of the next line, and control means responsive to a particular rotary position of at least one of said type wheels for operating said return means by the actuation of said carry means with said at least one type wheel being placed in said particular rotary position.

2. A printer according to claim 1, said particular rotary position being a blank portion formed free of any type element.

3. A printer according to claim 1, said carry means including a rack having a plurality of teeth extending along the line to be printed and a cam member carried by said impact means and having a helical projection adapted to engage said teeth to move said impact means and said carriage upon rotation of said cam.

4. A printer according to claim 3, including a unidirectional drive motor, and said selection means, said impact means, said carry means and said return means each receiving its motive power from said motor.

5. A printer according to claim 1, including a unidirectional drive motor, and said selection means, said impact means, said carry means and said return means each receiving its motive power from said motor.

6. A printer according to claim 1, further comprising feed means for feeding said record member for printing of a new line upon actuation of said return means.

7. A printer according to claim 6, including a unidirectional drive motor, and said selection means, said impact means, said carry means, said return means and said feed means each receiving its motive power from said motor.

8. A printer comprising a carriage adapted to be shifted along a line to be printed and carrying a plurality of type wheels each having a plurality of type elements spaced around respective areas of its circumference, selection means connected with said type wheels for rotating them and shifting them laterally within said carriage for bringing a respective area of any one of said type wheels into a printing position, impact means including a hammer movable along a line to be printed to bring said hammer into a printing position opposite the selected area for impacting a record medium between said hammer and any type element in said printing position, carry means interconnecting said impact means and said carriage for moving them unitarily along the line to be printed, return means for returning said carriage and said impact means to their initial position for the start of printing of the next line, and control means responsive to a particular rotary position of at least one of said type wheels for operating said return means by the actuation of said carry means with said at least one type wheel being placed in said particular rotary position, said carry means including a rack having a plurality of teeth extending along the line to be printed and a cam member carried by said impact means and having a helical projection adapted to engage said teeth to move said impact means and said carriage upon rotation of said cam, said return means including a spring urging said impact means and said carriage towards their initial position, and means connected to said rack for rotating it into a dis-engaged position out of engagement with said helical projection to enable said spring to return said impact means and said carriage to their initial position upon actuation of said carrying means with said at least one type wheel being placed in said particular rotary position.

9. A printer according to claim 8, said return means including a hold means for holding said rack in said dis-engaged position until a command is given to begin the printing of another line.

10. A printer according to claim 9, said hold means including a receiving tooth formed on said rack and a rack returning member located adjacent said initial position and adapted to return said rack from its dis-engaged position to engage said helical portion and said cam member only when said impact means is in its initial position.

11. A printer according to claim 8, including a unidirectional drive motor, and said selection means, said impact means, said carry means and said return means each receiving its motive power from said motor.

* * * * *